US008749336B2

(12) United States Patent
Lee et al.

(10) Patent No.: US 8,749,336 B2
(45) **Date of Patent: *Jun. 10, 2014**

(54) TRANSFORMER AND DISPLAY DEVICE USING THE SAME

(75) Inventors: Young Min Lee, Gyunggi-do (KR); Jae Sun Won, Gyunggi-do (KR); Jong Hae Kim, Gyunggi-do (KR); Deuk Hoon Kim, Gyunggi-do (KR); Geun Young Park, Gyunggi-do (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/442,496

(22) Filed: Apr. 9, 2012

(65) Prior Publication Data

US 2012/0319614 A1 Dec. 20, 2012

(30) Foreign Application Priority Data

Jun. 14, 2011 (KR) ..... 10-2011-0057275

(51) Int. Cl.
*H01F 27/30* (2006.01)

(52) U.S. Cl.
USPC ..... 336/198

(58) Field of Classification Search
USPC ..... 336/192, 196, 198, 200, 232
See application file for complete search history.

(56) References Cited

U.S. PATENT DOCUMENTS

| | | | | |
|---|---|---|---|---|
| 4,857,877 | A * | 8/1989 | Dethienne | 336/170 |
| 5,696,477 | A * | 12/1997 | Yamamori et al. | 336/192 |
| 6,509,822 | B2 * | 1/2003 | Junjie et al. | 336/198 |
| 8,058,962 | B2 * | 11/2011 | Zeng et al. | 336/208 |
| 2007/0064388 | A1 | 3/2007 | Uchizono et al. | |

FOREIGN PATENT DOCUMENTS

| | | | |
|---|---|---|---|
| JP | 7-042507 | U | 8/1985 |
| JP | 60-190019 | U | 12/1985 |
| JP | 6-55224 | U | 7/1994 |
| JP | 09-270341 | A | 10/1997 |
| JP | 10-241959 | A | 9/1998 |

(Continued)

OTHER PUBLICATIONS

Korean Office Action with English translation issued in Korean Application No. 10-2011-0057275 issued on Apr. 25, 2012.

(Continued)

*Primary Examiner* — Tuyen Nguyen
(74) *Attorney, Agent, or Firm* — McDermott Will & Emery LLP

(57) ABSTRACT

There is provided a transformer having a minimized leakage inductance. The transformer includes: a winding part including a pipe shaped body part having a plurality of coils wound therearound and flange parts extended from both ends of the body part in an outer diameter direction thereof; and a core coupled to the winding part, wherein a flange part formed at one end of the body part includes at least one lead groove, and the coils are led to the outside of the winding part through the at least one lead groove.

14 Claims, 15 Drawing Sheets

(56) References Cited

FOREIGN PATENT DOCUMENTS

| | | | |
|---|---|---|---|
| JP | 10-289829 | A | 10/1998 |
| JP | 11-026257 | A | 1/1999 |
| JP | 2000-182849 | A | 6/2000 |
| JP | 2000-294433 | A | 10/2000 |
| JP | 2001-237128 | A | 8/2001 |
| JP | 2003-282338 | A | 10/2003 |
| JP | 2007-035664 | | 2/2007 |
| JP | 2007-086444 | A | 4/2007 |
| JP | 2009-218388 | A | 9/2009 |
| JP | 2011-071203 | A | 4/2011 |
| KR | 10-2009-0046286 | A | 5/2009 |

OTHER PUBLICATIONS

Japanese Office Action with English translation issued in Japanese Application No. 2012-087177 mailed Jul. 16, 2013.

Japanese Office Action issued in Japanese Application No. 2012-087177 which issued on Mar. 11, 2014, with English translation, 9 pgs.

* cited by examiner

TRANSFORMER AND DISPLAY DEVICE USING THE SAME

CROSS-REFERENCE TO RELATED APPLICATIONS

This application claims the priority of Korean Patent Application No. 10-2011-0057275 filed on Jun. 14, 2011, in the Korean Intellectual Property Office, the disclosure of which is incorporated herein by reference.

BACKGROUND OF THE INVENTION

1. Field of the Invention

The present invention relates to a transformer, and more particularly, to a transformer having a minimized leakage inductance.

2. Description of the Related Art

Various kinds of power supplies are required in various electronic devices such as a television (TV), a monitor, a personal computer (PC), an office automation (OA) device, and the like. Therefore, these electronic devices generally include power supplies converting an alternating current (AC) power supplied from the outside into a power required for each electronic appliance.

Among power supplies, a power supply using a switching mode (for example, a switch mode power supply (SMPS)) has mainly recently been used. This SMPS basically includes a switching transformer.

The switching transformer generally converts an AC power of 85 to 265 V into a direct current (DC) power of 3 to 30 V through high frequency oscillation of 25 to 100 KHz. Therefore, the switching transformer has significantly reduced core and bobbin sizes as compared to a general transformer converting an AC power of 85 to 265 V into an AC current of 3 to 30 V through frequency oscillation of 50 to 60 Hz, and stably supplies a low voltage and low current DC power to an electronic appliance. Accordingly, the switching transformer has recently been widely used in an electronic appliance that has tended to be miniaturized.

This switching transformer needs to be designed to have a small leakage inductance in order to increase energy conversion efficiency. However, in accordance with the miniaturization of the switching transformer, it may be difficult to design a switching transformer having a small leakage inductance.

SUMMARY OF THE INVENTION

An aspect of the present invention provides a small sized switching transformer.

An aspect of the present invention also provides a transformer having a minimized leakage inductance.

According to an aspect of the present invention, there is provided a transformer including: a winding part including a pipe shaped body part having a plurality of coils wound therearound and flange parts extended from both ends of the body part in an outer diameter direction thereof; and a core coupled to the winding part, wherein a flange part formed at one end of the body part includes at least one lead groove, and the coils are led to the outside of the winding part through the at least one lead groove.

The transformer may further include a terminal connection part spaced apart from one end of the winding part by a predetermined distance and including a plurality of external connection terminals connected thereto.

The transformer may further include a lead wire skip part formed in a space between the winding part and the terminal connection part and including lead wires of the coils inserted thereinto to thereby be led to the external connection terminals.

The winding part may include a plurality of winding spaces divided by at least one partition wall formed on an outer peripheral surface of the body part.

The partition wall may include at least one skip groove formed therein, and the coils may be wound while skipping the partition wall through the at least one skip groove.

The lead wire skip part may include at least one guide protrusion formed therein, the at least one guide protrusion protruding from the terminal connection part or the flange parts.

The lead groove may be formed by cutting a portion of the flange part so that an outer peripheral surface of the body part is exposed.

The flange part formed at one end of the body part may include an extension groove in a portion of the lead groove adjacent to the body part, the extension groove formed by extending a width of the lead groove.

The extension groove may have a chamfered edge portion.

The flange part formed at one end of the body part may have an increased area in a direction in which the lead groove is formed to thereby have an area greater than that of the other flange part.

The terminal connection part may be exposed outwardly of the core.

The terminal connection part may be disposed to be spaced apart from one end of the winding part, corresponding to a thickness of the core.

The coils may include a plurality of primary coils and a plurality of secondary coils.

The coils may be wound and stacked such that the plurality of secondary coils may be interposed between the plurality of primary coils.

The primary coils may be multi-insulated coils.

At least one of the plurality of coils may be a multi-insulated coil.

The multi-insulated coil may be disposed in at least one of an innermost position or an outermost position of the coils wound and stacked in the winding part.

According to another aspect of the present invention, there is provided a display device including: a power supply including at least one transformer as described above mounted on a substrate thereof; a display panel receiving power from the power supply; and a cover protecting the display panel and the power supply.

The coils of the transformer may be wound so as to be parallel with the substrate of the power supply.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
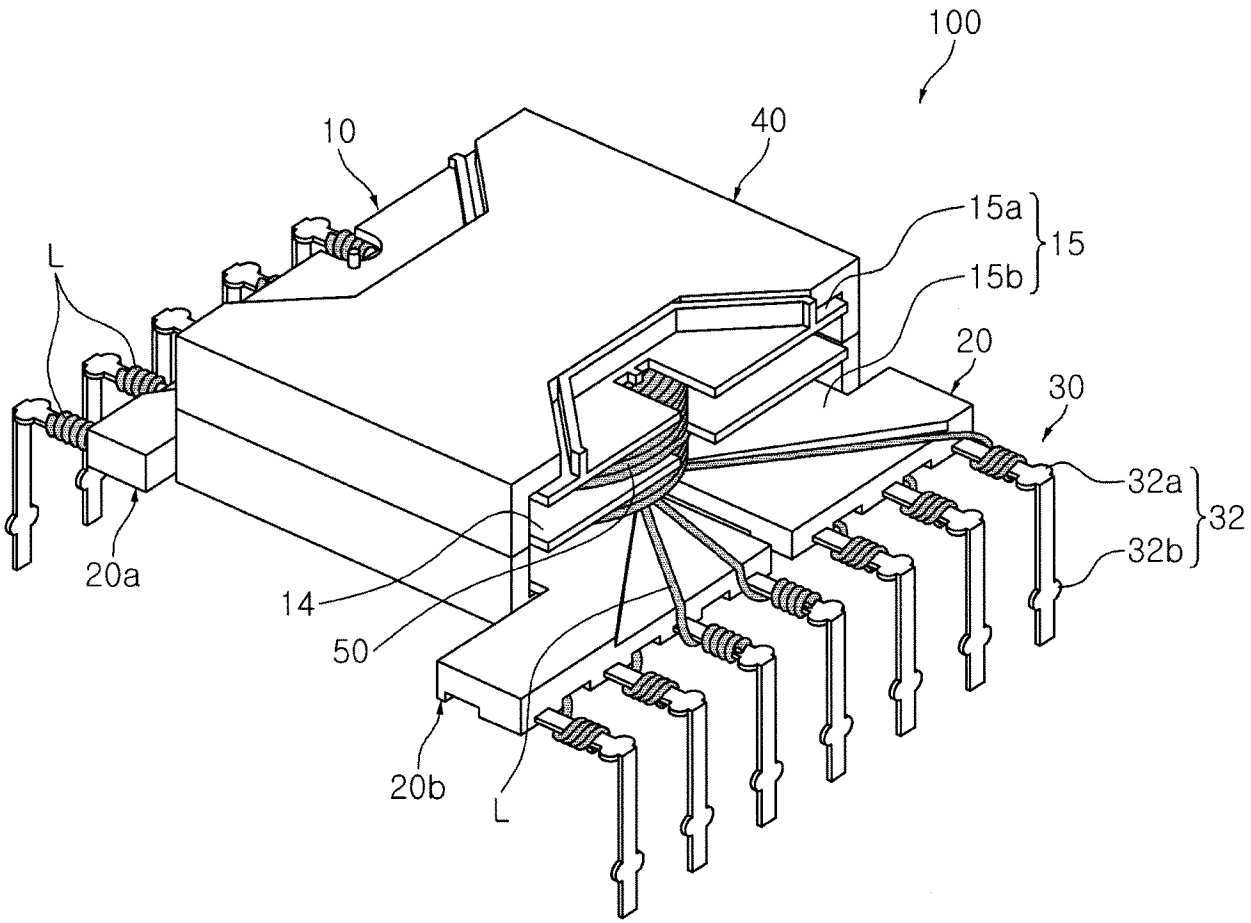
FIG. 1 is a perspective view schematically showing a transformer according to an embodiment of the present invention.

Prior to a detailed description of the present invention, the terms or words, which are used in the specification and claims to be described below, should not be construed as having typical or dictionary meanings. The terms or words should be construed in conformity with the technical idea of the present invention on the basis of the principle that the inventor(s) can appropriately define terms in order to describe his or her invention in the best way. Embodiments described in the specification and structures illustrated in drawings are merely exemplary embodiments of the present invention. Thus, it is intended that the present invention covers the modifications and variations of this invention, provided they fall within the scope of their equivalents at the time of filing this application.

Exemplary embodiments of the present invention will be described in detail with reference to the accompanying drawings. The same reference numerals will be used throughout to designate the same or like elements in the accompanying drawings. Moreover, detailed descriptions related to well-known functions or configurations will be ruled out in order not to unnecessarily obscure subject matters of the present invention. In the drawings, the shapes and dimensions of some elements may be exaggerated, omitted or schematically illustrated. Also, the size of each element does not entirely reflect an actual size.

Exemplary embodiments of the present invention will now be described in detail with reference to the accompanying drawings.

Figure 2A:
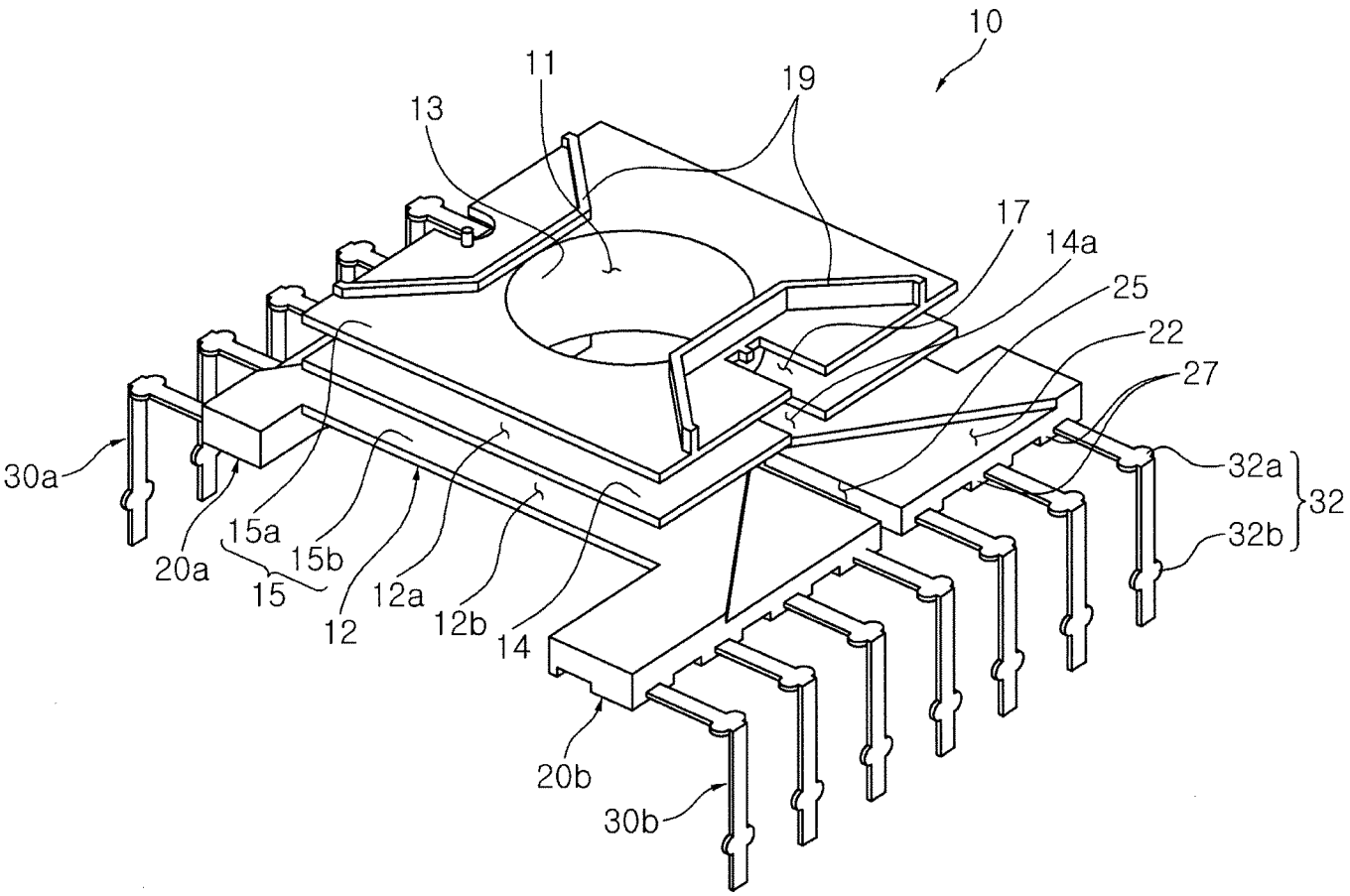
FIG. 2A is a perspective view schematically showing a bobbin of the transformer shown in FIG. 1.
Figure 2B:
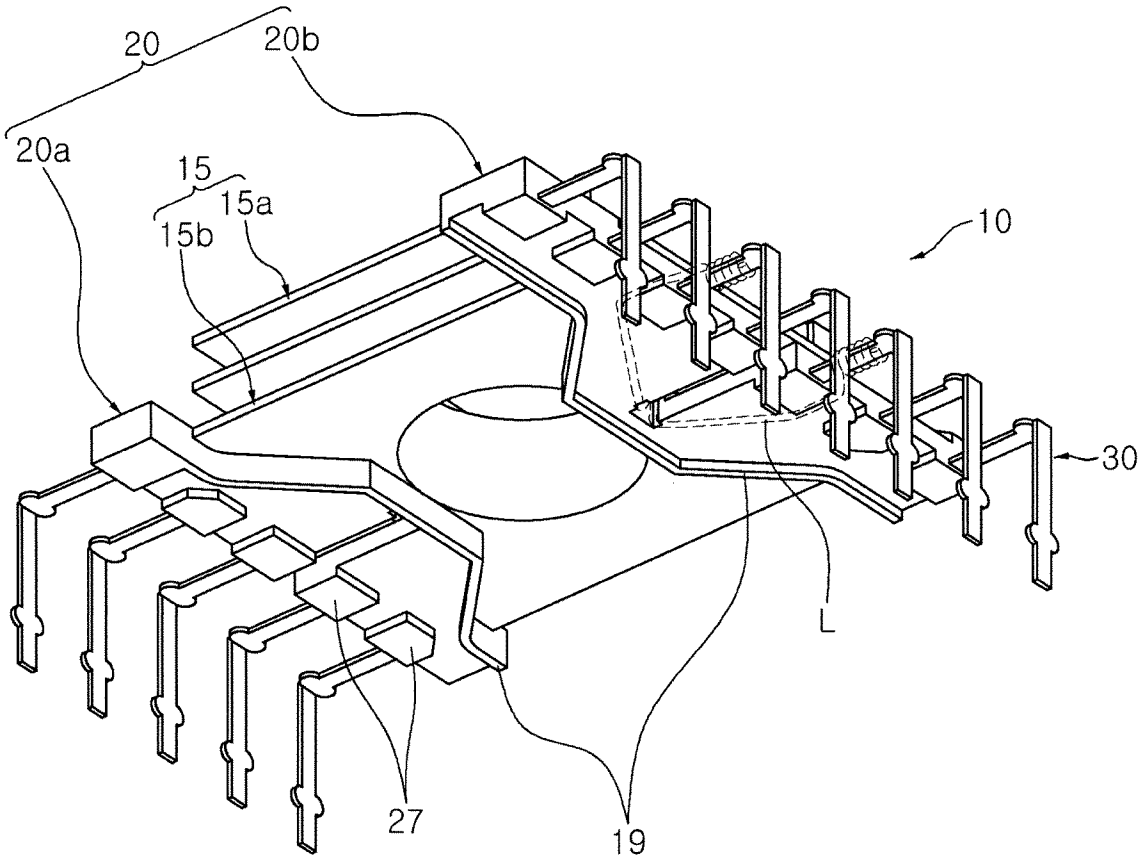
FIG. 2B is a perspective view schematically showing a lower surface of the bobbin shown in FIG. 2A.
Figure 3:
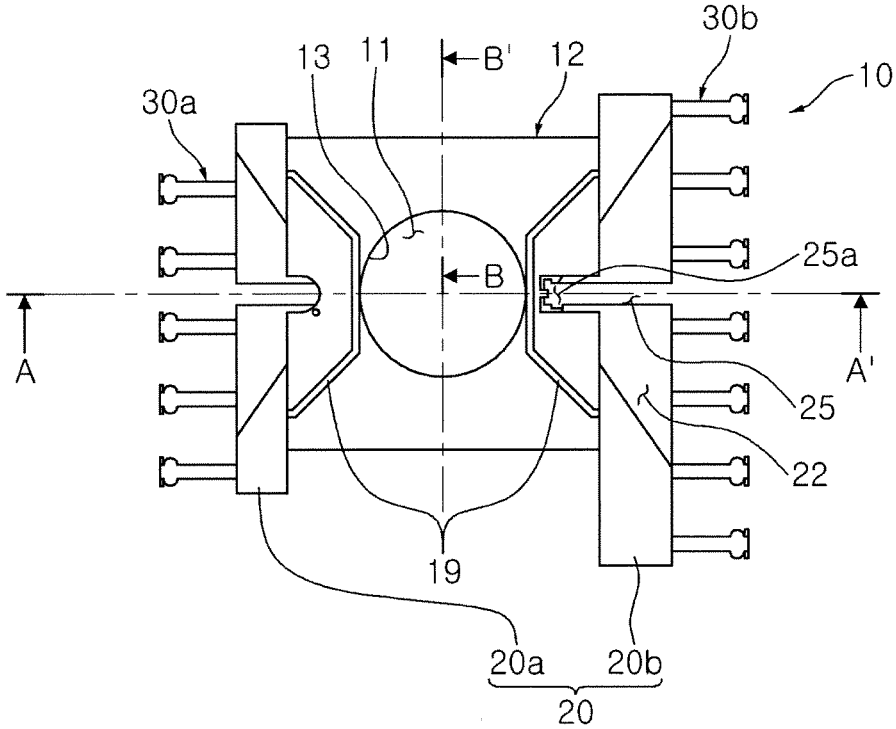
FIG. 3 is a plan view schematically showing the bobbin of FIGS. 2A and 2B.
Figure 4:
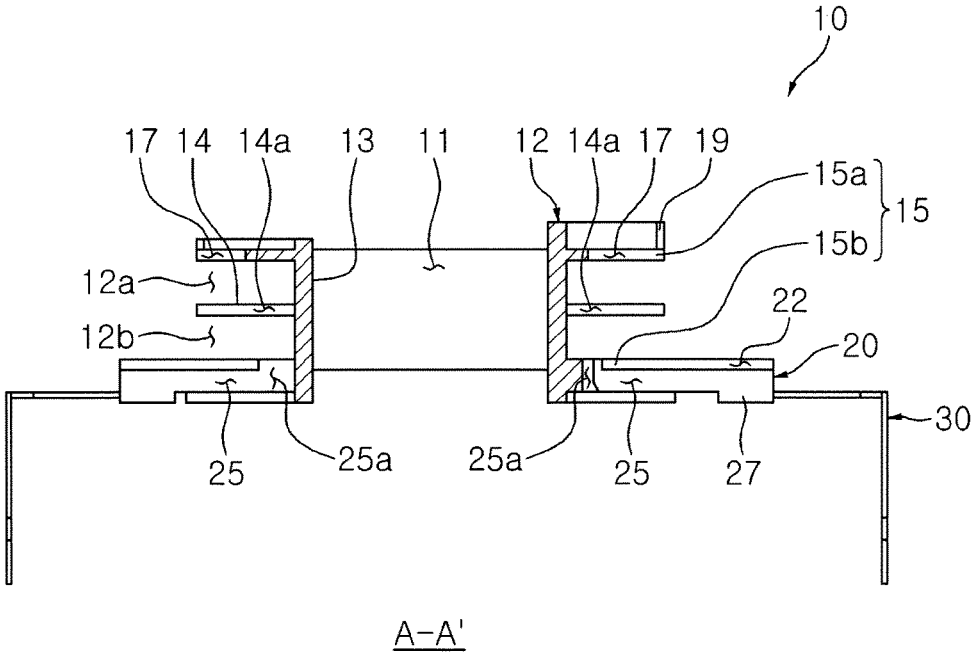
FIG. 4 is a cross-sectional view taken along line A-A' of FIG. 3.

FIG. 1 is a perspective view schematically showing a transformer according to an embodiment of the present invention; FIG. 2A is a perspective view schematically showing a bobbin of the transformer shown in FIG. 1; and FIG. 2B is a perspective view schematically showing a lower surface of the bobbin shown in FIG. 2A. FIG. 3 is a plan view schematically showing the bobbin of FIGS. 2A and 2B; and FIG. 4 is a cross-sectional view taken along line A-A' of FIG. 3.

Referring to FIGS. 1 through 4, a transformer 100 according to an embodiment of the present invention, which is an insulating type switching transformer, includes a bobbin 10, a core 40, and a coil 50.

The bobbin 10 includes a winding part 12 having the coil 50 wound therein and a terminal connection part 20 formed at one end of the winding part 12.

The winding part 12 may include a body part 13 having a pipe shape and a flange part 15 extended from both ends of the body part 13 in an outer diameter direction thereof.

The body part 13 may include a through hole 11 formed in an inner portion thereof and at least one partition wall 14 formed on an outer peripheral surface thereof, in which the through hole 11 includes the core 40 partially inserted therein and the partition wall 14 partitions a space in a length direction of the body part 13. In this configuration, each of the spaces partitioned by the partition wall 14 may include the coil 50 wound therein.

The winding part 12 according to the present embodiment includes a single partition wall 14. Therefore, the winding part 12 according to the present embodiment includes two partitioned spaces 12*a* and 12*b*. However, the present invention is not limited thereto. Various numbers of spaces may be formed and used through various numbers of partition walls 14 as necessary.

In addition, the partition wall 14 according to the present embodiment includes at least one skip groove 14*a* formed therein so that the coil 50 wound in the space 12*a* (hereinafter, referred to as an upper space) may skip the partition wall 14 to thereby be wound in the other space 12*b* (hereinafter, referred to as a lower space).

The skip groove 14*a* may have a shape in which a portion of the partition wall 14 is completely cut and removed so that an outer surface of the body part 13 is exposed. In addition, the skip groove 14*a* may have a width wider than a thickness (that is, a diameter) of the coil 50. The skip groove 14*a* may be formed as a pair corresponding to a position of the terminal connection part 20 to be described below.

The partition wall 14 according to the present embodiment is provided in order to uniformly dispose and wind the coil 50 in the partitioned spaces 12*a* and 12*b*. Therefore, the partition wall may have various thicknesses and be made of various materials as long as a shape thereof may be maintained.

Meanwhile, although the present embodiment describes a case in which the partition wall 14 is formed integrally with the bobbin 10 by way of example, the present invention is not limited thereto but may be variously applied. For example, the partition wall 14 may be formed as an independent separate member and be then coupled to the bobbin 10.

The partition wall 14 according to the present embodiment may have approximately the same shape as that of the flange part 15.

The flange part 15 protrudes in a manner in which it is extended from both ends, that is, upper and lower ends, of the body part 13 in the outer diameter direction thereof. The flange part 15 according to the present embodiment may be divided into an upper flange part 15*a* and a lower flange part 15*b* according to a formation position thereof.

In addition, spaces between the outer peripheral surface of the body part 13 and the upper and lower flange parts 15*a* and 15*b* are formed as the winding spaces 12*a* and 12*b* in which the coil 50 is wound. Therefore, the flange part 15 serves to protect the coil 50 from the outside and secure insulation properties between the coil 50 and the outside, while simultaneously serving to support the coil 50 in the winding spaces 12*a* and 12*b* at both sides thereof.

Meanwhile, in order to form the thin transformer 100, the flange part 15 of the bobbin 10 may have a maximally thin thickness. However, in the case in which the bobbin 10 is made of a resin material, which is an insulating material, when the flange part 15 has an excessively reduced thickness, the flange part 15 does not maintain its shape, such that it may be bent.

Therefore, the bobbin 10 according to the present embodiment may include an insulating rib 19 formed on an outer surface of the flange part 15 in order to prevent the flange part 15 from being bent and reinforce the flange part 15.

The insulating rib 19 may be formed on both outer surfaces of the two flange parts 15*a* and 15*b* or be selectively formed on either outer surface thereof as necessary.

The present embodiment describes a case in which the individual insulating ribs 19 are formed on the outer surfaces of the upper and lower flange parts 15*a* and 15*b* by way of example. Here, the insulating ribs 19 may protrude to have a shape corresponding to that of the core 40, that is, an hourglass shape along a side of the core 40. In addition, the core 40 may be disposed between the insulating ribs 19 and be coupled to the bobbin 10.

When the insulating ribs 19 are formed according to the shape of the core 40 as described above, they serve to secure insulation properties between the coil 50 wound in the bobbin 10 and the core 40, while simultaneously serving to guide a position of the core 40 when the core 40 is coupled to the bobbin 10.

Therefore, the insulating rib 19 may protrude with a thickness similar to that of the core 40 of the transformer 100. However, the present invention is not limited thereto but may be variously applied. For example, a protrusion distance of the insulating rib 19 may be set corresponding to a creepage distance between the coil 50 and the core 40.

Meanwhile, when the bobbin 10 is made of a material having high strength and the flange part 15 thus maintains its shape without being bent even if the insulating rib 19 is not formed, the insulating rib 19 may be omitted.

In addition, the bobbin 10 according to the present embodiment may include at least one penetration groove 17 formed in the upper flange part 15*a*. The penetration groove 17 is provided in order to allow observation of a wound state of the coil 50 wound in the winding part 12 with the naked eye. Therefore, when it is not required to observe the wound state of the coil 50, the penetration groove 17 may be omitted.

This penetration groove 17 may be formed corresponding to positions and shapes of the skip groove 14*a* and a lead groove 25 to be described below. That is, the skip groove 14*a*, the lead groove 25, and the penetration groove 17 may be disposed in a straight line in a vertical direction (a Z direction). Therefore, a worker and a user may easily recognize the wound state of the coil 50 within the respective winding spaces 12*a* and 12*b* through the penetration groove 17.

The terminal connection part 20 may be formed in the lower flange part 15*b*. More specifically, the terminal connection part 20 according to the present embodiment may protrude from the lower flange part 15*b* in an outer diameter direction in order to secure an insulation distance.

However, the present invention is not limited thereto. The terminal connection part 20 may protrude downwardly of the lower flange part 15*b*.

Meanwhile, referring to the accompanying drawings, since the terminal connection part 20 according to the present embodiment is partially extended from the lower flange part 15*b*, it is difficult to precisely distinguish between the lower flange part 15*b* and the terminal connection part 20. Therefore, in the present embodiment, the lower flange part 15*b* itself may also be perceived as the terminal connection part 20.

External connection terminals 30 to be described below may be connected to the terminal connection part 20 in a manner such that they protrude outwardly of the terminal connection part 20.

In addition, the terminal connection part 20 according to the present embodiment may include a primary terminal connection part 20*a* and a secondary terminal connection part 20*b*. Referring to FIG. 1, the present embodiment describes a case in which the primary terminal connection part 20*a* and the secondary terminal connection part 20*b* are extended from respective exposed ends of the lower flange part 15*b* by way of example. However, the present invention is not limited thereto but may be variously applied. For example, the primary terminal connection part 20*a* and the secondary terminal connection part 20*b* may be formed on any one end of the lower flange part 15*b* or be formed adjacent to each other.

In addition, the terminal connection part 20 according to the present embodiment may include a guide groove 22, the lead groove 25, and guide protrusions 27 in order to guide a lead wire L of the coil 50 wound in the winding part 12 to the external connection terminal 30.

The guide groove 22 is formed in one surface, that is, an upper surface, of the terminal connection part 20. The guide groove 22 may be formed of a plurality of grooves each separated corresponding to positions at which the respective external connection terminals 30 are disposed, or may be formed in a single integral groove shape as shown in the accompanying drawings.

In addition, although not shown, the guide groove 22 may have a bottom surface and an edge portion that are inclined at a predetermined angle or curved (for example, chamfered), in order to minimize bending of the lead wires L connected to the external connection terminals 30 at an edge portion of the terminal connection part 20.

The lead groove 25 is used in a case in which the lead wire L of the coil 50 wound in the winding part 12 leads to a lower portion of the terminal connection part 20, as shown by a dotted line in FIG. 2B. To this end, the lead groove 25 according to the present embodiment may be formed in a shape in which portions of the terminal connection part 20 and the lower flange part 15*b* are completely cut so that the outer surface of the body part 13 is exposed.

In addition, the lead groove 25 may have a width wider than thicknesses (that is, diameters) of a primary coil 51 and a secondary coil 52.

Particularly, the lead groove 25 according to the present embodiment is formed at a position corresponding to that of the skip groove 14*a* of the partition wall 14. More specifically, the lead groove 25 may be formed so as to have approximately the same width as that of the skip groove 14*a* at a position on which the skip groove 14*a* projects downwardly.

The lead groove 25 may be formed as a pair corresponding to the position of the terminal connection part 20, similar to the skip groove 14*a*. However, the present invention is not limited thereto. The lead groove 25 may also be formed in plural at various positions as necessary.

In addition, the lead groove 25 according to the present embodiment may include an extension groove 25*a* having an extended width at a position adjacent to the body part 13.

The extension groove 25*a* has a width wider than that of the lead groove 25. Here, boundary portions between the lead grove 25 and the extension groove 25*a* may be at a right angle to each other or protrude in a protrusion shape. Therefore, the lead wire L disposed in the extension groove 25*a* may not easily move to the lead groove 25, and may support a sidewall of the extension groove 25*a* and be disposed in a changed direction.

Although the present embodiment describes a case in which the extension groove 25*a* is formed to have a width extended from the lead groove 25 in both directions thereof by way of example, the present invention is not limited thereto but may be variously applied. For example, the extension groove may be extended only in one direction, or a plurality of extension grooves rather than a single extension groove may be formed.

A lower portion, that is, an edge portion connected to a lower surface of the terminal connection part 20, of the extension groove 25*a* may be formed as an inclined surface or a curved surface by chamfering, or the like. Therefore, a phenomenon in which the lead wire L, led through the extension groove 25*a*, is bent by the edge portion of the extension groove 25*a* may be minimized.

The lead groove 25 and the extension groove 25*a* according to the present embodiment have been developed in order to minimize a leakage inductance generated at the time of driving of the transformer 100.

In the case of the related art transformer, the lead wire of the coil is configured to lead to the outside along an inner wall surface of a space in which the coil is wound, such that the wound coil and the lead wire of the coil are in contact with each other.

Therefore, the coil is wound to be bent at a portion at which it contacts the lead wire thereof and the bending, that is, non-uniform winding, of the coil causes an increase in leakage inductance.

However, in the transformer 100 according to the present embodiment, the lead wire L of the coil 50 is not disposed in the winding part 12 but directly leads from the wound position to an outer portion of the winding part 12, that is, the lower portion of the terminal connection part 20 through the lead groove 25 and the extension groove 25*a* in a vertical direction.

Therefore, the coil 50 may be entirely uniformly wound in the winding part 12. Accordingly, leakage inductance, generated due to the above-described bending of the coil 50 or the like, may be minimized.

A plurality of guide protrusions 27 may protrude from one surface of the terminal connection part 20 in parallel with each other. The present embodiment describes a case in which the plurality of guide protrusions 27 protrude downwardly from the lower surface of the terminal connection part 20 by way of example.

The guide protrusion 27 is provided to guide the lead wire L of the coil 50 wound in the winding part 12 so that the lead wire L is easily disposed from the lower portion of the terminal connection part 20 to the external connection terminal 30, as shown in FIG. 2B. Therefore, the guide protrusions 27 may protrude beyond a diameter of the lead wire L of the coil 50 so as to guide the coil 50 disposed therebetween while firmly supporting the coil 50.

Due to the guide protrusions 27, the lead wire L of the coil 50 wound in the winding part 12 moves to the lower portion of the terminal connection part 20 while passing through the lead groove 25, and is then electrically connected to the external connection terminal 30 through a space between the adjacent guide protrusions 27. Here, the lead wire L of the coil 50 may be disposed in a changed direction while supporting sides of the extension groove 25*a* and the guide protrusions 27 to thereby be connected to the external connection terminal 30.

The terminal connection part 20 according to the present embodiment configured as described above has been developed in consideration of a case in which the coil 50 is automatically wound in the bobbin 10.

That is, due to the configuration of the bobbin 10 according to the present embodiment, processes of winding the coil 50 in the bobbin 10, skipping the lead wire L of the coil 50 to the lower portion of the bobbin 10 through the skip groove 25, changing a route of the lead wire L through the guide protrusion 27 to thereby lead the lead wire L in a direction in which the external connection terminal 30 is formed, and connecting the lead wire L to the external connection terminal 30, and the like, may be automatically performed through a separate automatic winding device (not shown).

In addition, according to the related art, when a plurality of individual coils are wound in the bobbin, the lead wires of the coils lead to the external connection terminals are disposed to intersect with each other. Therefore, the lead wires contact each other, thereby causing a short circuit between the coils.

However, in the transformer 100 according to the present embodiment, the lead wires L of the coil 50 may be disposed on one surface (the guide groove of the terminal connection part) and the other surface (the lower surface on which the guide protrusion is formed) of the lower flange part 15*b* in a distributed scheme and be connected to the external connection terminals 30. Therefore, the lead wires L of the coil 50 are connected to the external connection terminals 30 through more routes as compared to the related art transformer, whereby intersection or contact between the plurality of lead wires L may be minimized.

The terminal connection part 20 may include a plurality of external connection terminals 30 connected thereto. The external connection terminals 30 may protrude outwardly from the terminal connection part 20 and have various shapes according to the shape or structure of the transformer 100 or the structure of a substrate having the transformer 100 mounted thereon.

That is, the external connection terminals 30 according to the present embodiment are connected to the terminal connection part 20 such that they protrude from the terminal connection part 20 in the outer diameter direction of the body part 13. However, the present invention is not limited thereto. The external connection terminals 30 may be formed at various positions as necessary. For example, the external connection terminals 30 may be connected to the terminal connection part 20 such that they protrude downwardly from the lower surface of the terminal connection part 20.

In addition, the external connection terminal 30 according to the present embodiment includes an input terminal 30*a* and an output terminal 30*b*.

The input terminal 30*a* is connected to the primary terminal connection part 20*a*, and is connected to the lead wire L of the primary coil 51 to thereby supply a power to the primary coil 51. In addition, the output terminal 30*b* is connected to the secondary terminal connection part 20*b*, and is connected to the lead wire L of the secondary coil 52 to thereby supply an output power set according to a turn ratio between the secondary coil 52 and the primary coil 51.

The external connection terminal 30 according to the present embodiment includes a plurality of (for example, four) input terminals 30*a* and a plurality of (for example, seven) output terminals 30*b*. This configuration has been developed because the transformer 100 according to the present embodiment has a structure in which the plurality of coils 50 are wound together in a single winding part 12. Therefore, in the transformer 100 according to the present embodiment, the number of external connection terminals 30 is not limited to the above-mentioned number.

In addition, the input terminal 30*a* and the output terminal 30*b* may have the same shape or have different shapes from each other as necessary. In addition, the external connection terminal 30 according to the present embodiment may be variously modified as long as the lead wire L is easily connected thereto.

For example, as shown in the accompanying drawings, the external connection terminal 30 may have a plurality of protrusions 32. These protrusions 32 may include a protrusion 32*a* serving to divide a connection position of the coil 50 and a protrusion 32*b* setting a mounting height of the transformer when the transformer is mounted on the substrate.

The bobbin 10 according to the present embodiment as described above may be easily manufactured by an injection molding method. However, a method of forming the bobbin 10 is not limited thereto. In addition, the bobbin 10 according to the present embodiment may be made of an insulating resin and be made of a material having high heat resistance and high voltage resistance. As a material of the bobbin 10, polyphenylenesulfide (PPS), liquid crystal polyester (LCP), polybutyleneterephthalate (PBT), polyethyleneterephthalate (PET), phenolic resin, and the like, may be used.

The core 40 is partially inserted into the through-hole formed in an inner portion of the bobbin 10 and is electromagnetically coupled to the coil 50 to thereby form a magnetic path.

The core 40 according to the present embodiment is configured in a pair. The pair of cores 40 may be partially inserted into the through-hole 11 of the bobbin 10 to thereby be coupled to each other so as to face each other. As the core 40, an 'EE' core, an 'EI' core, a 'UU' core, a 'UI' core, and the like, according to a shape thereof may be used.

In addition, the core 40 according to the present embodiment may have an hourglass shape in which a portion thereof contacting the flange part 15 is partially concave according to a shape of the insulating rib 19 of the bobbin 10 described above. However, the present invention is not limited thereto.

The core 40 may be made of Mn—Zn based ferrite having higher permeability, lower loss, higher saturation magnetic flux density, higher stability, and lower production costs, as compared to other materials. However, in the embodiment of the present invention, the shape or material of the core 40 is not limited.

Meanwhile, although not shown, in order to secure insulation properties between the coil 50 wound in the bobbin 10 and the core 40, an insulating tape may be interposed between the bobbin 10 and the core 40.

The insulating tape may be interposed between the bobbin 10 and the core 40 corresponding to the entire inner surface of the core 40 facing the bobbin 10 or be partially interposed therebetween only at a portion at which the coil 50 and the core 40 face each other.

The coil 50 may be wound in the winding part 12 of the bobbin 10 and include the primary and secondary coils.

Figure 5:
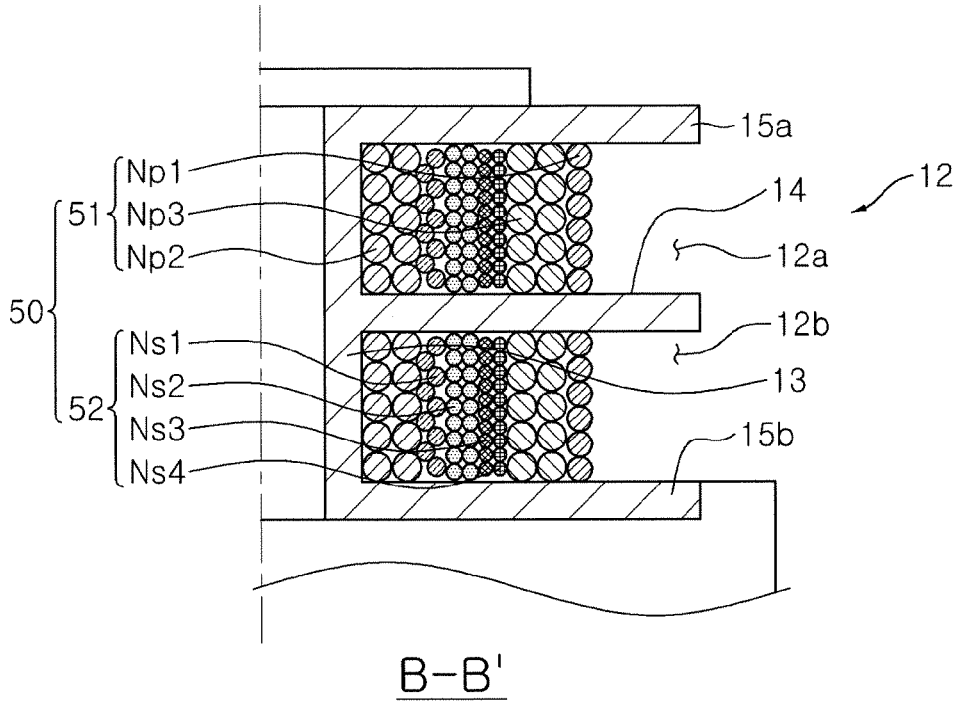
FIG. 5 is a partial cross-sectional view taken along line B-B' of FIG. 3.
Figure 6:
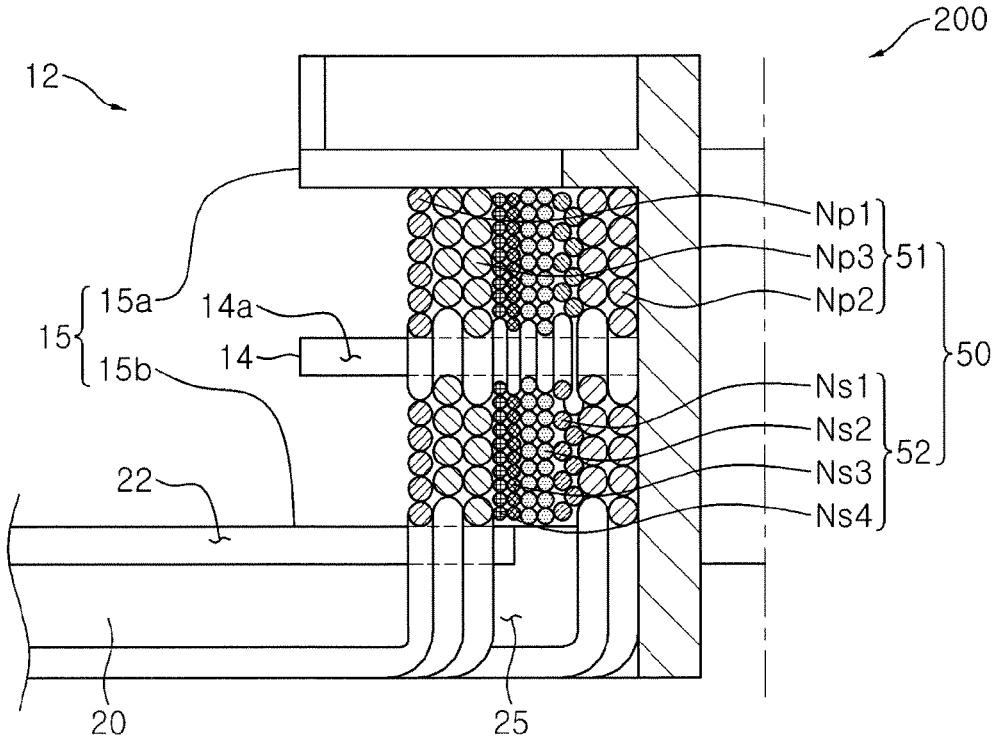
FIG. 6 is a partial cross-sectional view taken along line A-A' of FIG. 3.

FIG. 5 is a cross-sectional view taken along line B-B' of FIG. 3; and FIG. 6 is a partial cross-sectional view taken along line A-A' of FIG. 3. FIGS. 5 and 6 show a cross section in a state in which the coil 50 is wound in the bobbin 10.

Referring to FIGS. 5 and 6, the primary coil 51 may include a plurality of coils Np1, Np2, and Np3 that are electrically insulated from each other. The present embodiment describes a case in which the primary coil 51 is formed by individually winding each of three independent coils Np1, Np2, and Np3 in a single winding part 12 by way of example. Therefore, in the primary coil 51 according to the present embodiment, a total of six lead wires L lead to thereby be connected to the external connection terminals 30. Meanwhile, for convenience of description, only a few lead wires L are representatively shown in FIG. 1.

Referring to FIG. 5, the primary coil 51 according to the present embodiment includes the coils Np1, Np2, and Np3 having a similar thickness. However, the present invention is not limited thereto. Each of the coils Np1, Np2, and Np3 configuring the primary coil 51 may also have different thicknesses as necessary. In addition, the respective coils Np1, Np2, and Np3 may have the same number of turns or have a different number of turns as necessary.

Further, in the transformer 100 according to the present invention, when a voltage is applied to at least any one (for example, Np2 or Np3) of the plurality of primary coils 51 Np1, Np2, and Np3, a voltage may also be drawn into the other primary coil (for example, Np1) by electromagnetic induction. Therefore, the transformer may also be used in a display device to be described below.

As described above, in the transformer 100 according to the present embodiment, the primary coil 51 is configured of the plurality of coils Np1, Np2, and Np3, such that various voltages may be applied and be drawn through the secondary coil 52*b* correspondingly.

Meanwhile, the primary coil 51 according to the present embodiment is not limited to the three independent coils Np1, Np2, and Np3 as described in the present embodiment but may include various numbers of coils as necessary.

The secondary coil 52 is wound in the winding part 12, similar to the primary coil 51. Particularly, the secondary coil 52 according to the present embodiment is wound while being stacked in a sandwich structure between the primary coils 51.

The secondary coil 52 may be formed by winding a plurality of coils electrically insulated from each other, similar to the primary coil 51.

More specifically, the present embodiment describes a case in which the secondary coil 52 includes four independent coils Ns1, Ns2, Ns3, and Ns4 electrically insulated from each other by way of example. Therefore, in the secondary coil 52 according to the present embodiment, a total of eight lead wires L may lead to thereby be connected to the external connection terminals 30.

In addition, as the respective coils Ns1, Ns2, Ns3, and Ns4 of the secondary coil 52, coils having the same thickness or coils having different thicknesses may be selectively used. The respective coils Ns1, Ns2, Ns3, and Ns4 may also have the same number of turns or have a different number of turns as necessary.

Particularly, the transformer 100 according to the present embodiment has a feature in a structure in which the primary coil 51 and the secondary coil 52 are wound. Hereinafter, a detailed description thereof will be provided with reference to the accompanying drawings.

As described above, the primary coil 51 according to the present embodiment includes three independent coils (hereinafter, referred to as Np1, Np2, and Np3). In addition, the secondary coil 52 includes four independent coils (hereinafter, referred to as Ns1, Ns2, Ns3, and Ns4).

These respective coils 50 may be wound on the outer peripheral surface of the body part 13 in a manner such that they are disposed thereon in various orders and forms.

In the present embodiment, Np2 of the primary coils 51 is wound on the outer peripheral surface of the body part 13, and Np3 and Np1 thereof are sequentially wound at an outermost position of the winding space 12*a* and 12*b* in a state in which they are spaced apart from Np2 by a predetermined interval. In addition, Ns1, Ns2, Ns3, and Ns 4, which are the secondary coils 52, are sequentially disposed between Np2 and Np3.

Here, Np2 and Np3 of the primary coils 51 may be configured such that they are made of the same material and have the same number of turns and each of lead wires L thereof is connected to the same external connection terminal 30.

Further, in the secondary coil 52, a coil of which a lead wire L is connected to the external connection terminal 30 disposed in an outermost position of the terminal connection part 20 may be disposed in an innermost position thereof. That is, in the embodiment of FIG. 5, a lead wire L of Ns1 may be connected to the external connection terminal 30 disposed in the outermost position among the external connection terminals 30.

However, the present invention is not limited thereto but may be variously applied. For example, the disposition order of the respective individual coils Np1 to Ns4 may be set based on voltages drawn in the respective individual coils Np1 to Ns4 or turns of the respective individual coils Np1 to Ns4.

The respective coils Np1 to Ns4 according to the present embodiment are wound in the spaces 12*a* and 12*b* partitioned by the partition wall 14 in a uniformly distributed scheme.

More specifically, the respective coils Np1 to Ns4 are wound to have the same number of turns in each of the upper and lower winding spaces 12*a* and 12*b*, and are disposed to vertically form the same layer as shown in FIG. 5. Therefore, the respective coils Np1 to Ns4 wound in the upper and lower winding spaces 12*a* and 12*b* are wound to have the same shape.

This configuration is to minimize the generation of leakage inductance in the transformer 100 according to the wound state of the coil 50.

Generally, when the coils are wound in the winding part of the bobbin, they are not wound uniformly but may be wound while being inclined toward one side or while being non-uniformly disposed. In this case, leakage inductance in the transformer may be increased. In addition, this problem may be intensified as the space of the winding part becomes large.

Therefore, in the transformer 100 according to the present embodiment, the winding part 12 is partitioned into the spaces 12*a* and 12*b* by the partition wall 14 in order to minimize leakage inductance generated for the above-mentioned reason. In addition, the coils 50 are uniformly wound in the respective partitioned spaces 12*a* and 12*b*.

FIGS. 7A through 7E are views describing a method for winding coils shown in FIG. 5. Hereinafter, a method for winding coils of the transformer 100 according to the present embodiment will be described with reference to FIGS. 7A through 7E.

Figure 7A:
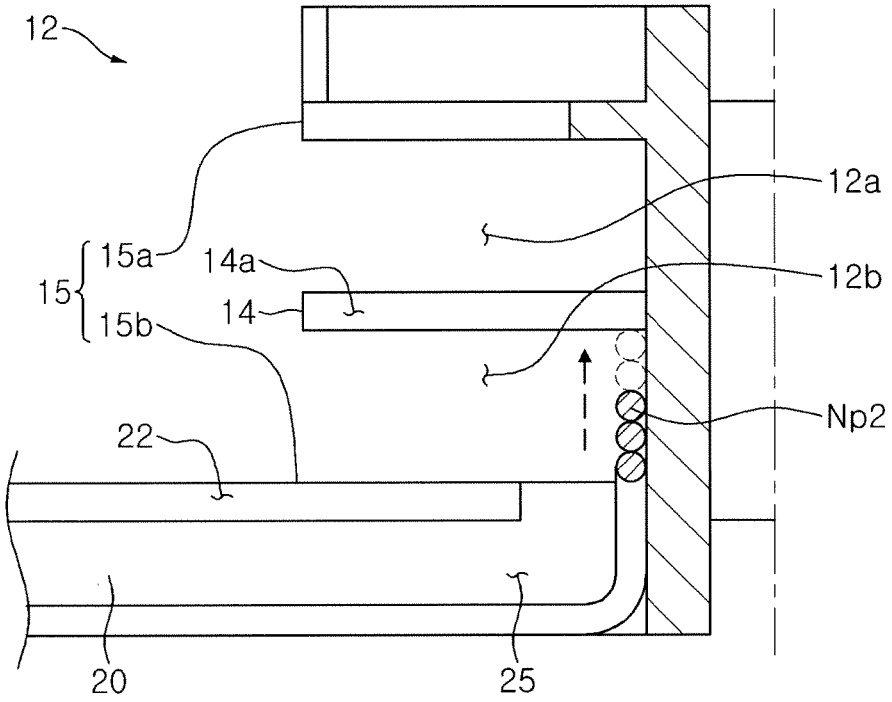
FIGS. 7A through 7E are views describing a method for winding coils shown in FIG. 5.

First referring to FIG. 7A, a specific coil (for example, Np2) is first wound while forming a single layer in the lower winding space 12*b*. Here, Np2 is the primary coil, such that it leads from a lower surface of the primary terminal connection part 20*a* to the lower winding space 12*b* through the lead groove 25.

Np2 led into the lower winding space 12*b* starts to be wound in a lower end of the lower winding space 12*b* (that is, an inner surface of the lower flange part) and is then sequentially wound toward an upper portion of the bobbin 10.

Figure 7B:
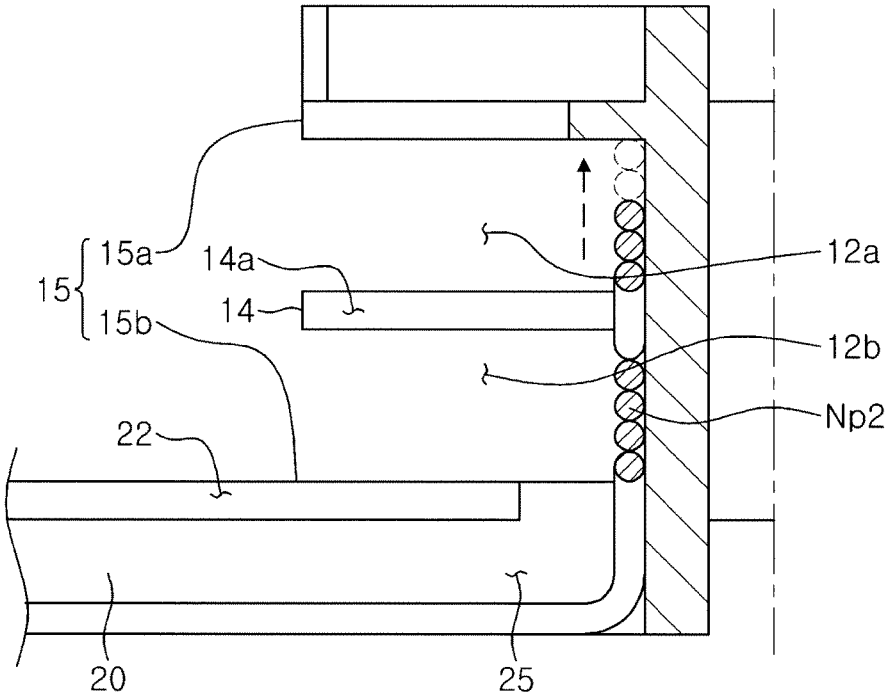

Then, as shown in FIG. 7B, Np2 is skipped to the upper winding space 12*a* through the skip groove 14*a*, and is also wound while forming a single layer in the upper winding space 12*a*. As in the lower winding space 12*b*, Np2 is sequentially wound toward the upper portion of the bobbin 10.

Figure 7C:
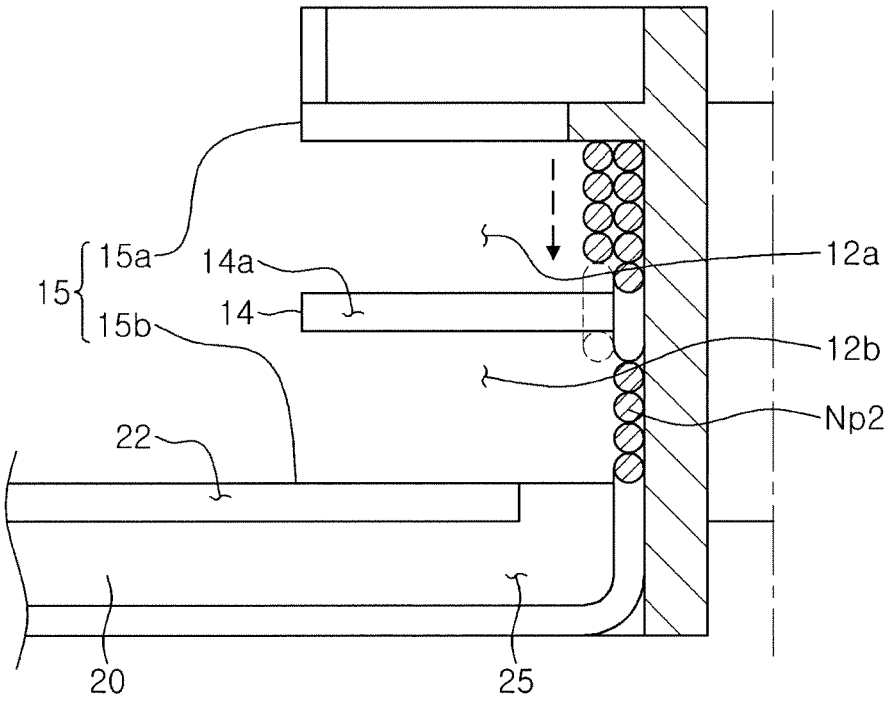
Figure 7D:
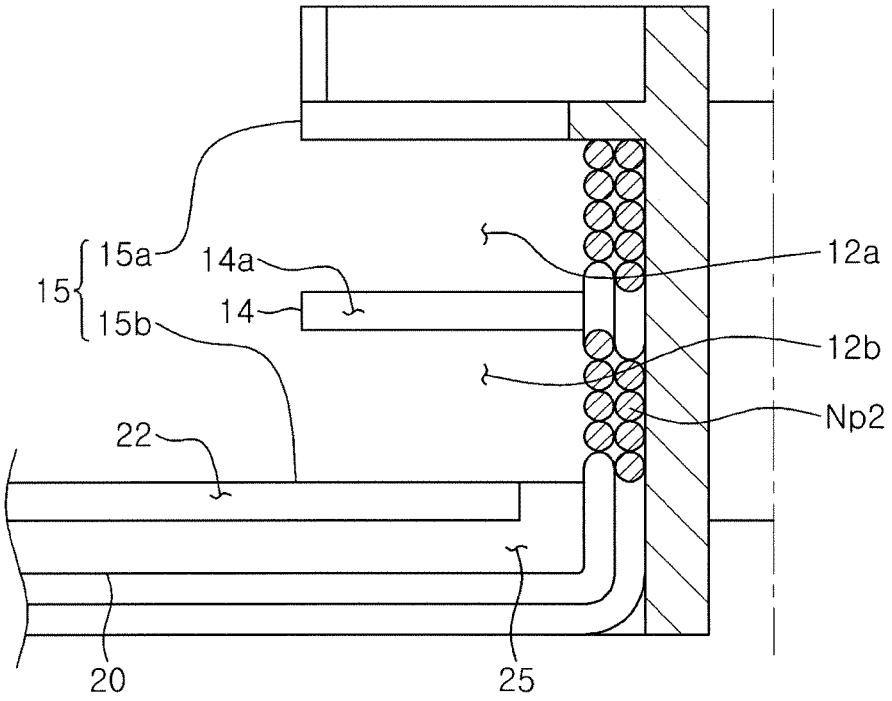

After Np2 is wound while forming the single layer in the upper and lower winding spaces 12*a* and 12*b* through the above-mentioned process, Np2 is again wound in a shape in which it is stacked on Np2 wound in FIG. 7B while forming a new layer thereon, as shown in FIG. 7C. Then, Np2 is also uniformly wound in the lower winding space 12*b*, corresponding to the above-mentioned process, as shown in FIG. 7D.

Figure 7E:
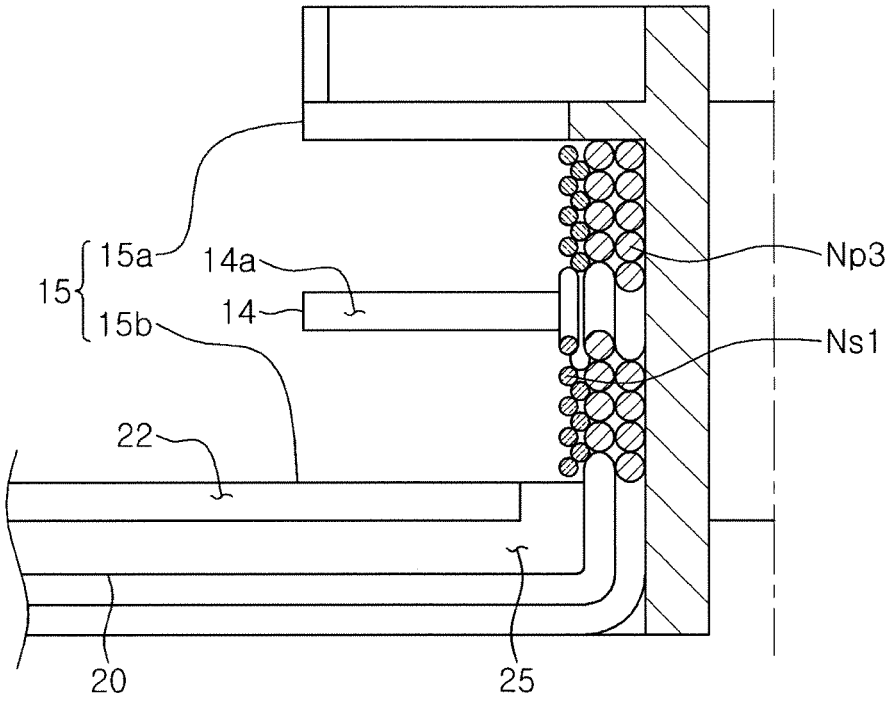

Next, another coil (for example, Ns1) may be wound in a shape in which it is stacked on Np2 while forming a new layer on Np2 through the same process as the above-mentioned process, as shown in FIG. 7E. Here, Ns1 is the secondary coil, such that it is wound while leading from a lower surface of the secondary terminal connection part 20*b* to the lower winding space 12*b* through the skip groove.

When winding of remaining coils (for example, in the order of Ns2, Ns3, Ns4, Np3, Np1) is completed through the above-mentioned process, the coils are wound as shown in FIG. 5.

Here, as described above, each of the coils Np1 to Ns4 wound in the upper and lower winding spaces 12*a* and 12*b* is set to have the same number of turns. For example, when Ns1 has 18 total turns, it is wound nine times in the upper winding space 12*a* and nine times in the lower winding space 12*b* so that it is disposed in a uniformly distributed scheme.

In addition, when the turns of Ns1 are set as an odd number, Ns1 may be differentially wound in the upper and lower winding spaces in the ratio within 10% of the total turns. For example, when Ns1 has 50 turns, it is wound twenty three times in the upper winding space and twenty seven times in the lower winding space.

Meanwhile, referring to the accompanying drawings, in the case of the present embodiment, Ns1 is non-densely wound and is wound eight times in a first layer and ten times in a second layer. Therefore, since both of two lead wires (not shown) of Ns1 are directed to a lower portion of the winding part 12, they may easily lead to the terminal connection part 20 to thereby be connected to the external connection terminal 30.

Although the accompanying drawings show the above-mentioned winding structure only with respect to Ns1 for convenience of description, the present invention is not limited thereto. The above-mentioned winding structure may also be easily applied to the other coils.

As described above, in the case of the transformer 100 according to the present embodiment, even if turns or a thickness of the coil are smaller than widths of the winding spaces 12*a* and 12*b*, such that the coil (for example, Ns1) may not be densely wound within the winding part 12, the winding part 12 is partitioned into the plurality of spaces 12*a* and 12*b*, such that the coil (for example, Ns1) may be wound so as to be disposed in the same position within the respective partitioned spaces 12*a* and 12*b* in a distributed scheme without being inclined toward any one side.

In the transformer 100 according to the present embodiment, the respective independent coils Np1 to Ns4 are disposed in the upper and lower winding spaces 12*a* and 12*b* in a uniformly distributed scheme according to the winding scheme and the structure of the bobbin 10 described above. Therefore, in the entire winding part 12, a phenomenon in which the coils Np1 to Ns4 are wound while being inclined toward any one side or are non-uniformly wound while being spaced apart from each other may be prevented. As a result, leakage inductance generated due to the non-uniform winding of the coils Np1 to Ns4 may be minimized.

Meanwhile, a general insulated coil (for example, a polyurethane wire) or the like may be used as the coils Np1 to Ns4 according to the present embodiment. A twisted pair of wires formed by twisting several strands of wire (for example, a Litz wire, or the like) may be used. In addition, a multi-insulated coil having high insulation properties (for example, a triple insulated wire (TIW)) may be used. That is, types of the coils may be selected as necessary.

In addition, although not shown in the accompanying drawings, an insulating tape or an insulating layer may be interposed between the respective individual coils in order to secure insulation properties therebetween.

However, the present invention is not limited thereto. That is, since insulation properties between the respective individual coils may be secured in a case in which all (or some) of the respective individual coils are the multi-insulated wires such as TIW or the like, the insulating tape may be omitted.

Multi-insulated wire is a coil of which insulation properties are increased by forming an insulator having several layers (for example, three layers) on an outer portion of a conductor. When the triple insulated coil 51*b* is used, insulation properties between a conductor and the outside are easily secured, whereby an insulation distance between the coils may be minimized. However, this multi-insulated wire has increased manufacturing costs as compared to a general insulated coil (for example, a polyurethane wire).

Therefore, in the transformer according to the present embodiment, in order to minimize manufacturing costs and reduce manufacturing processes, only any one of the primary and secondary coils 51 and 52 may be the multi-insulated coil.

Referring again to FIG. 5, the transformer 100 according to the present embodiment uses the multi-insulated coils as the primary coils 51 by way of example. In this case, the multi-insulated coils, which are the primary coils 51, are disposed in each of the innermost and outmost positions of the coils 50 wound in the winding part 12 while being stacked therein.

When the multi-insulated coils are disposed in the innermost and outmost positions of the coils 50 wound as described, the multi-insulated coils, which are the primary coils, serve as an insulating layer between the secondary coils 52, which are general insulated coils, and the outside. Therefore, the insulation properties between the outside and the secondary coil 52 may be easily secured.

Meanwhile, although the present embodiment describes a case in which the multi-insulated coils, which are the primary coils 51, are disposed in both of the innermost and outmost positions of the coils 50 by way of example, the present invention is not limited thereto. That is, the multi-insulated coils may be selectively disposed only in any one of the innermost and outmost positions of the coils 50 as necessary.

In addition, the coils may be disposed in various forms as necessary, as will be described below.

Figure 8:
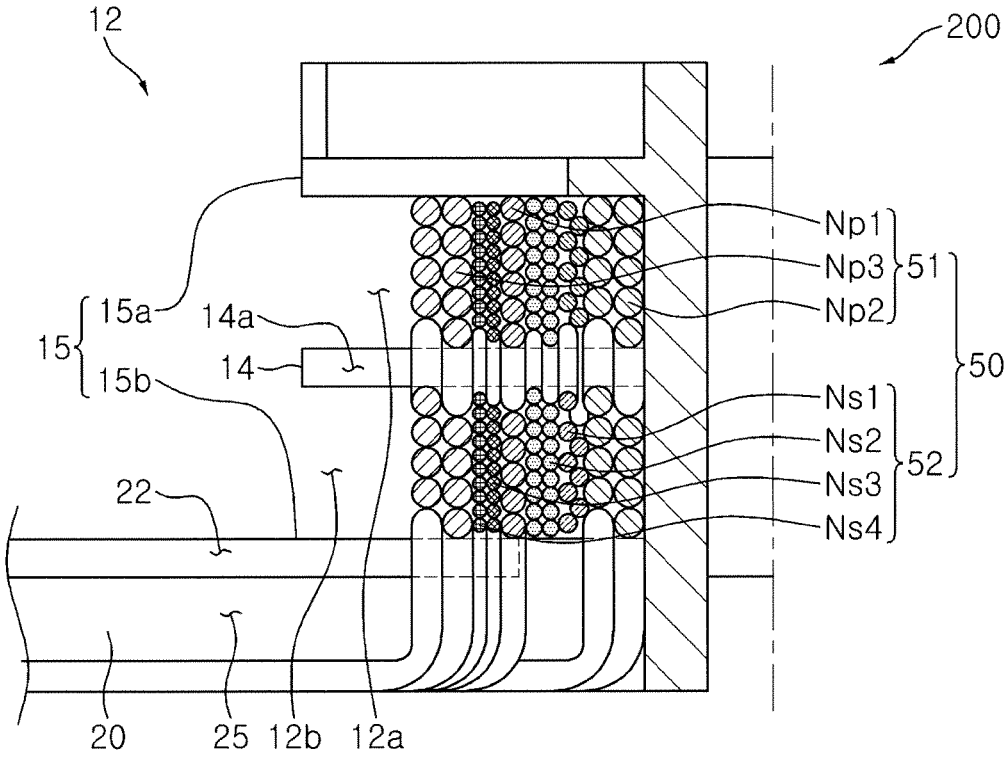
FIG. 8 is a perspective view showing a transformer according to another embodiment of the present invention.

FIG. 8 is a perspective view showing a transformer according to another embodiment of the present invention. FIG. 8 shows a cross section in a state in which a coil is wound in a bobbin, taken along line A-A' of FIG. 3.

Referring to FIG. 8, a coil according to the present embodiment includes the primary coil 51 and the secondary coil 52, similar to the above-mentioned embodiment.

That is, the primary coil 51 includes three independent coils (hereinafter, referred to as Np1, Np2, and Np3), and the secondary coil 52 includes four independent coils (hereinafter, referred to as Ns1, Ns2, N3*s*, and Ns4). Here, a difference between voltages applied to Ns2 and Ns3 of the secondary coil 52 may be greatest.

In addition, in the coil according to the present embodiment, at least one of the primary and secondary coils 51 and 52 may be multi-insulated wires. The present embodiment describes a case in which the primary coils 51 are the multi-insulated wires and the secondary coils 52 are general coils (for example, polyurethane wires) by way of example.

These primary coils 51 are disposed to be spaced apart from each other by a predetermined interval within the winding part 12, and the secondary coils 52 are interposed in spaces between the primary coils 51.

More specifically, in a transformer 200 according to the present embodiment, anyone individual coil (for example, Np2) of the primary coils 51 is wound on an outer peripheral surface of the bobbin 10. In addition, some (for example, Ns1 and Ns2) of the secondary coils 52 are sequentially wound while being stacked on an outer portion of Np2.

Further, another individual coil (for example, Np1) of the primary coil 51 is again wound while being stacked on an outer portion of Ns2, and the other secondary coils 52 (for example, Ns3 and Ns4) are sequentially wound while being stacked on an outer portion of Np1. Furthermore, another primary coil (for example, Np3) is wound while being stacked on the outermost position.

That is, in the transformer 200 according to the present embodiment, Np2 is wound on the outer peripheral surface of the body part 13, and Np3 is wound to be spaced apart from Np2 so that it is disposed in the outermost position. In addition, Ns1 and Ns2, which are the secondary coils 52, are sequentially disposed between Np2 and Np1, and Ns3 and Ns4, which are the secondary coils 52, are sequentially disposed between Np1 and Np3. That is, Np1 is interposed between the secondary coils 52.

Since the secondary coil 52 according to the present embodiment is configured such that a difference between voltages individually applied to Ns2 and Ns3 is largest as described above, when the above-mentioned two individual coils Ns2 and Ns3 are disposed adjacent to each other and a separate insulating layer (for example, an insulating tape) is not interposed therebetween, insulation therebetween may be destroyed.

Therefore, the transformer according to the present embodiment has a coil form in which Np1, which is the primary coil 51, is interposed between Ns2 and NS3. That is, the individual coils Ns1, Ns2, Ns3, and Ns4 having a large difference between voltages applied thereto among the secondary coils 52 are disposed to be spaced apart from each other by the primary coils 51.

As described above, all of the primary coils 51 according to the present embodiment are multi-insulated wires having high insulation properties. In this case, insulation properties between Ns2 and NS3 having a large difference between voltages applied thereto may be secured by Np1 having high insulation properties.

In addition, when all of the primary coils 51 are the multi-insulated wires as described above, insulation properties between the primary and secondary coils 51 and 52 may be secured by the primary coils 51 having high insulation properties. In the transformer 200 according to the present embodiment, an insulating tape that has been interposed between the primary and secondary coils 51 and 52 according to the related art may be omitted.

Therefore, the transformer 200 according to the present embodiment may have reduced manufacturing costs as compared to a case in which the insulating tape is used or all of the coils 50 are the multi-insulated coils. In addition, since a process of attaching the insulating tape may be omitted, a manufacturing process is reduced, whereby a manufacturing time may be minimized.

Furthermore, since the coil (for example, Np3) disposed in the outermost position of the winding part 12 is the multi-insulated wire, insulation properties between the corresponding coil Np3 and the core 40 (See FIG. 1) may be easily secured.

Meanwhile, the present embodiment describes a case in which only the primary coils 51 are the multi-insulated wires by way of example, the present invention is not limited thereto. That is, even if the secondary coils 52 rather than the primary coils 51 are the multi-insulated wires, the same effect may be obtained.

In addition, although the present embodiment describes a case in which the secondary coils 52 are disposed between the primary coils 51, the present invention is not limited thereto.

The primary coils 51 may be appropriately disposed between the secondary coils 52 as necessary.

The transformer configured as described above is not limited to the above-mentioned embodiments but may be variously applied.

A transformer to be described below has a similar shape to that of the transformer according to the above-mentioned embodiment and is mainly different therefrom in a structure of a bobbin. Therefore, a detailed description of the same configuration as that of the transformer according to the above-mentioned embodiment will be omitted, and a structure of a bobbin will be mainly described.

Figure 9:
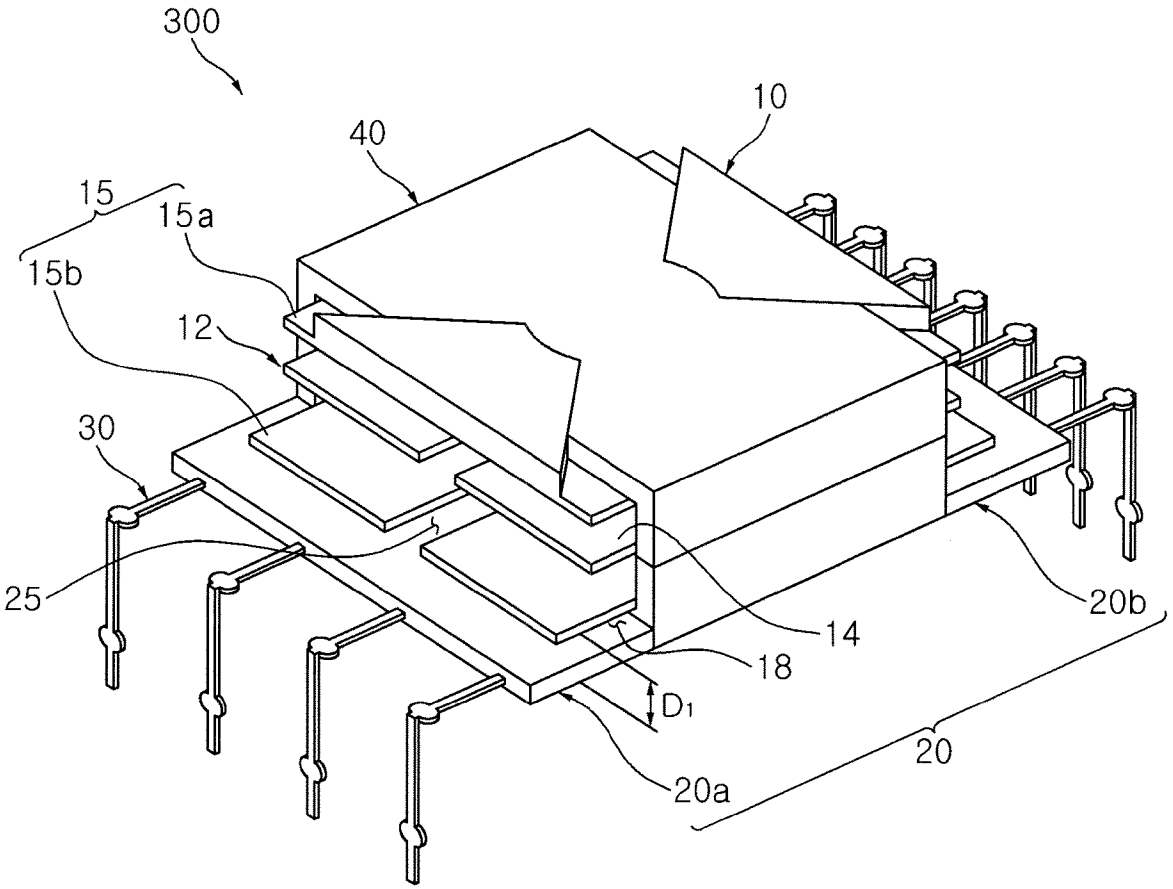
FIG. 9 is a perspective view showing a transformer according to another embodiment of the present invention.
Figure 10A:
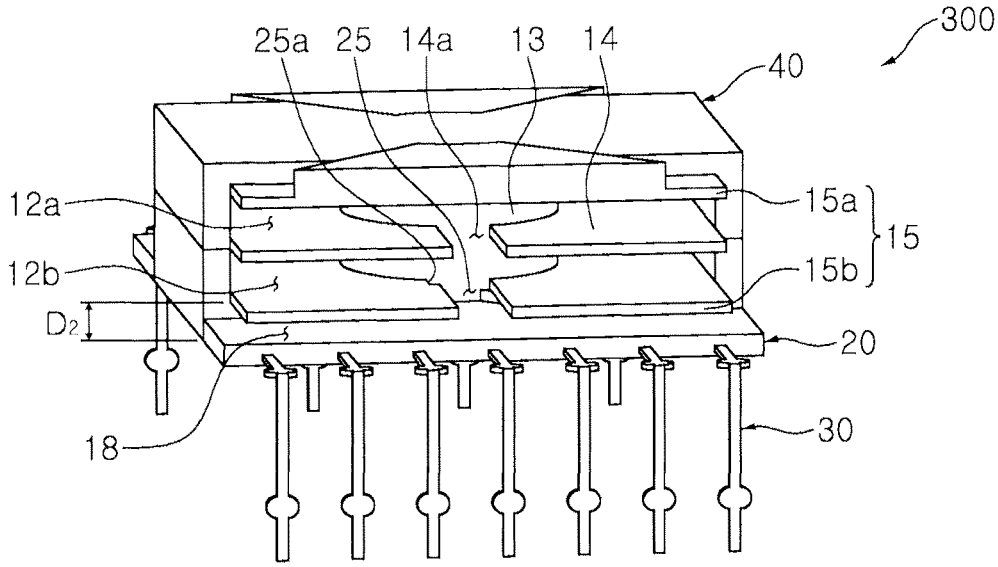
FIGS. 10A and 10B are perspective views showing a side of the transformer shown in FIG. 9.
Figure 10B:
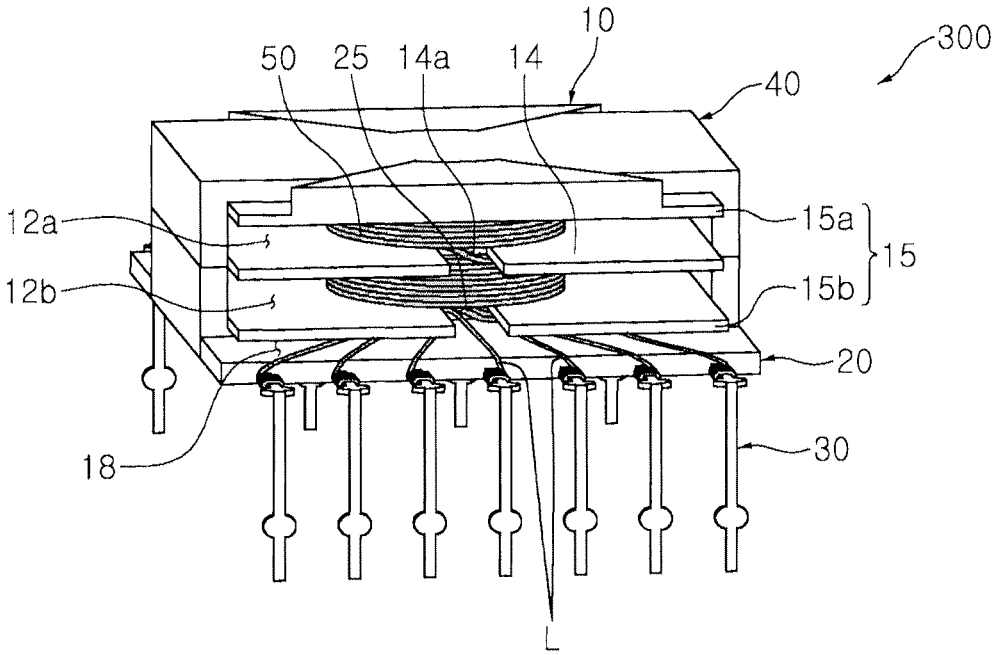
Figure 11:
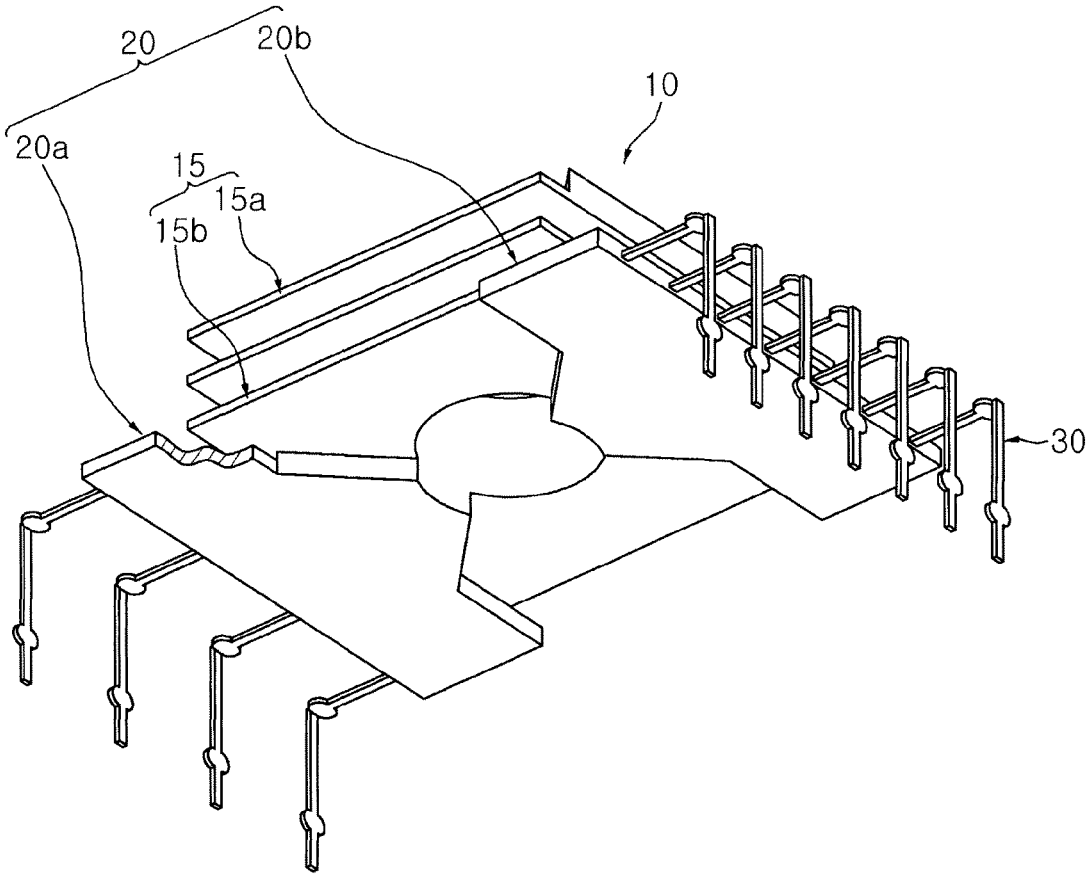
FIG. 11 is a perspective view schematically showing a lower surface of a bobbin shown in FIG. 9.

FIG. 9 is a perspective view showing a transformer according to another embodiment of the present invention; and FIGS. 10A and 10B are perspective views showing a side of the transformer shown in FIG. 9. Here, FIGS. 9 and 10A show a transformer in a state in which a coil is omitted, and FIG. 10B shows a transformer in a state in which a coil is wound. FIG. 11 is a perspective view schematically showing a lower surface of a bobbin shown in FIG. 9.

Referring to FIGS. 9 through 11, a transformer 300 according to the present embodiment includes the coil 50, the bobbin 10, and the core 40.

The coil 50 is configured to be the same as that of the above-mentioned embodiment. Therefore, a detailed description thereof will be omitted.

The core 40 is partially inserted into the through-hole 11 formed in the inner portion of the bobbin 10 and is electromagnetically coupled to the coil 50 to thereby form a magnetic path.

The core 40 according to the present embodiment is configured in a pair. The pair of cores 40 may be partially inserted into the through-hole 11 of the bobbin 10 to thereby be coupled to each other so as to face each other.

In addition, the core 40 according to the present embodiment may have an hourglass shape in which a portion (hereinafter, a lower surface) disposed in a lower portion of the transformer 300 is partially concave. This shape, which corresponds to the shape of the terminal connection part 20 of the bobbin 10 to be described below, will be described in detail in a description of the terminal connection part 20.

The bobbin 10 according to the present embodiment includes the body part 13, the winding part 12 including the flange part 15 extended from both ends of the body part 13 in an outer diameter direction thereof, and the terminal connection part 20 formed under the winding part 12.

The winding part 12 is configured to be similar to that of the above-mentioned embodiment. That is, the coil 50 is wound on the outer peripheral surface of the body part 13, and a space of the winding part 12 is partitioned by the partition wall 14. The partition wall 14 may include the skip groove 14*a* formed therein, as described in the above embodiment.

In addition, the body part 13 includes the upper and lower flange parts 15*a* and 15*b* formed on both ends thereof. Further, the lower flange part 15*b* may include the lead groove 25 and the extension groove 25*a* formed therein, as described in the above embodiment.

Meanwhile, in the transformer 300 according to the present embodiment, lead wires L of the coil are disposed in a lower space 18 (hereinafter, referred to as a lead wire skip part) of the lower flange part 15*b*. Therefore, the lower flange part 15*b* may protrude outwardly to be longer than the upper flange part 15*a* in order to secure insulation properties (for example, a creepage distance, or the like) between the lead wires L and the coils 50 wound in the winding part. That is, the lower flange part 15*b* may have an increased area in a direction in which the lead groove 25 is formed to thereby have an area greater than that of the upper flange part 15*a*.

The terminal connection part 20 is formed under the lower flange part 15*b* so as to be spaced apart therefrom by a predetermined interval. More specifically, the terminal connection part 20 may be formed in a shape in which it is extended downwardly from the lower flange part 15*b* by a predetermined distance and protrudes from and protrudes from the extended distal end in an outer diameter direction of the body part 13 to be parallel with the lower flange part 15*b*.

This terminal connection part 20 may be formed as a pair 20*a* and 20*b* under both ends of the lower flange part 15*b* exposed to the outside of the core 40. These two terminal connection parts 20*a* and 20*b* may include primary and secondary coils respectively connected thereto. However, the present invention is not limited thereto but may be variously applied. For example, only a single terminal connection part may be formed under any one end of the lower flange part and both of the primary and secondary coils 51 and 52 may be connected thereto.

In addition, a space between two terminal connection parts 20*a* and 20*b* is used to allow a portion of the core 40 (that is, a lower surface of the core) to be inserted. Therefore, the space between terminal connection parts 20*a* and 20*b* may have a shape corresponding to an outer shape of the lower surface of the core 40.

As described above, the lower surface of the core 40 according to the present embodiment has a partially convex shape. Therefore, the terminal connection part 20 is extended downwardly from the lower flange part 15*b* along the shape of the core 40. Accordingly, a space having a predetermined size is secured between the lower flange part 15*b* and the terminal connection part 20.

The space secured between the lower flange part 15*b* and the terminal connection part 20 is used as the lead wire skip part 18, in which the lead wire L of the coil 50 is disposed.

Therefore, the coil 50 wound in the winding part 12 leads to the lower portion of the lower flange part 15*b* through the lead groove 25 of the lower flange part 15*b* to thereby be disposed in the lead wire skip part 18. In addition, the lead wire L may be disposed in a changed direction within the lead wire skip part 18 to thereby be connected to the external connection terminal 30.

Here, the lead wire L may be inserted into the extension groove 25*a* formed in the lower flange part 15*b* and be then disposed in a changed direction while supporting the sidewall of the extension groove 25*a*. However, the present invention is not limited thereto. That is, a separate guide protrusion (not shown) may be formed within the lead wire skip part 18 in order to dispose the lead wire L in a changed direction.

The guide protrusion may protrude from the upper surface of the terminal connection part 20 in a protrusion shape, which is a shape similar to that of the guide protrusion 27 (See FIG. 2) of the above-mentioned embodiment. However, the present invention is not limited thereto but may be variously applied. For example, the guide protrusion may protrude from the lower surface of the lower flange part 15*b*.

In this case, the lead wire L within the lead wire skip part 18 may be disposed in a changed direction while supporting a side of the guide protrusion.

In the transformer 300 according to the present embodiment configured as described above, the lead wire L of the coil 50 is not disposed in the winding part 12 but directly leads from a position at which it is wound to the lead wire skip part 18 through the lead groove 25 and the extension groove 25*a* in a vertical direction and is then connected to the external connection terminal 30.

Therefore, the coil 50 wound in the winding part 12 may be uniformly wound. Accordingly, leakage inductance generated due to the bending of the coil 50, or the like, may be minimized.

In addition, the separate lead wire skip part 18 is provided, whereby the plurality of lead wires L may be more easily disposed therein. In addition, since the lead wires L are disposed within the lead wire skip part 18, exposure of the lead wires L to the outside may be minimized, such that damages to the lead wires L due to physical contact between the lead wires L and the outside may be prevented.

Meanwhile, in the transformer 300 according to the present invention, a spaced distance between the terminal connection part 20 and the lower flange part 15*b* corresponds to the thickness of the core 40. More specifically, a vertical distance D1 (See FIG. 9) from the lower surface of the lower flange part 15*b* to the lower surface of the terminal connection part 20 may be equal to or smaller than a thickness D2 (See FIG. 10A) of the lower surface of the core 40. Therefore, the lower surface of the terminal connection part 20 is disposed on the same plane as the lower surface of the core 40 or is disposed in a position higher than the lower surface of the core 40.

Due to this configuration, even in the case that the transformer 300 according to the present embodiment further includes the lead wire skip part 18 as compared to the transformer 100 (See FIG. 1) according to the above-mentioned embodiment, it may have the same height as that of the transformer 100 in the entire size of the transformer.

Meanwhile, the present invention is not limited to the above-mentioned configuration but may be variously applied. For example, the lower surface of the terminal connection part 20 may also be disposed in a position lower than the lower surface of the core 40.

In addition, although the present embodiment describes a case in which the terminal connection part 20 and the winding part 12 are formed integrally with each other by way of example, the present invention is not limited thereto but may be variously applied. For example, the winding part 12 and the terminal connection part 20 may be individually manufactured and be then coupled to each other, thereby form an integral bobbin.

Figure 12:
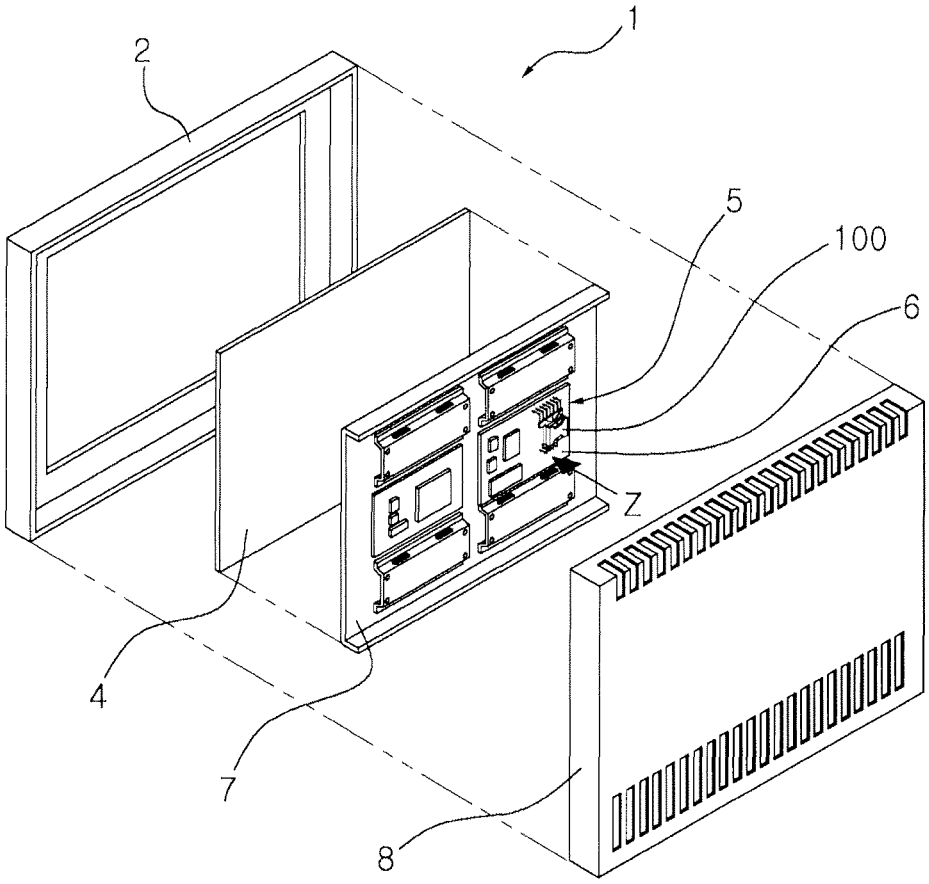
FIG. 12 is an exploded perspective view schematically showing a flat panel display device according to an embodiment of the present invention.

FIG. 12 is an exploded perspective view schematically showing a flat panel display device according to an embodiment of the present invention.

Referring to FIG. 12, a flat panel display device 1 according to an embodiment of the present invention may include a display panel 4, a switching mode power supply (SMPS) 5 having the transformer 100 mounted therein, and a cover 2 and 8.

The cover may include a front cover 2 and a back cover 8 and may be coupled to each other to thereby form an internal space therebetween.

The display panel 4 is disposed in the internal space formed by the cover 2 and 8. As the display panel, various flat panel display panels such as a liquid crystal display (LCD), a plasma display panel (PDP), an organic light emitting diode (OLED), and the like, may be used.

The SMPS 5 provides power to the display panel 4. The SMPS 5 may be formed by mounting a plurality of electronic components on a printed circuit board 6 and particularly, may include at least one of the transformers 100, 200, and 300 according to the above-mentioned embodiments mounted therein. The present embodiment describes a case in which the SMPS includes the transformer 100 of FIG. 1 by way of example.

The SMPS 5 may be fixed to a chassis 7, and be fixedly disposed in the internal space formed by the cover 2 and 8.

Here, the transformer 100 mounted in the SMPS 5 has the coil 50 (See FIG. 1) wound in a direction that is parallel with the printed circuit board 6. In addition, when being viewed from a plane of the printed circuit board 6 (a Z direction), the coil 50 is wound clockwise or counterclockwise. Therefore, a portion (an upper surface) of the core 40 forms a magnetic path while being parallel with the back cover 8.

Therefore, in the transformer 100 according to the present embodiment, a magnetic path of most magnetic flux formed between the back cover 8 and the transformer 100 among a magnetic field generated by the coil 50 is formed in the core 40, whereby the generation of leakage magnetic flux between the back cover 8 and the transformer 100 may be minimized.

Therefore, even if the transformer 100 according to the present embodiment does not include a separate shielding device on the outside thereof, vibrations of the back cover 8 may be prevented due to interference between the leakage flux of the transformer 100 and the back cover 8 made of a metal material.

Therefore, even if the transformer 100 is mounted in a thin electronic device such as the flat panel display device and the back cover 8 and the transformer 100 have a significantly narrow space therebetween, the generation of noise due to vibrations of the back cover 8 may be prevented.

As set forth above, in the transformer according to the embodiments of the present invention, the winding space of the bobbin is uniformly partitioned into a plurality of spaces, and the respective individual coils are wound in the partitioned spaces in a uniformly distributed scheme. In addition, the respective individual coils are wound in a stacked manner.

Therefore, a phenomenon in which the individual coils are wound while being inclined toward any one side or are non-uniformly wound while being spaced apart from each other within the winding part may be prevented. As a result, leakage inductance generated due to the non-uniform winding of the coils may be minimized In addition, the transformer according to the embodiments of the present invention uses multi-insulated wires as at least one of the primary and secondary coils. In this case, due to the multi-insulated wire having high insulation properties, insulation properties between the primary and secondary coils may be secured without using a separate insulating layer (for example, an insulating tape).

Therefore, the insulating tape that has been interposed between the primary and secondary coils according to the related art and a process of attaching the insulating tape may be omitted, whereby manufacturing costs and manufacturing time may be reduced.

Particularly, only some of the individual coils are the multi-insulated coils, and when the coils are disposed in a stacked manner, the multi-insulated wires are interposed between the individual coils having a large difference between voltages applied thereto. Therefore, insulation properties between the individual coils may be secured through the use of a minimal number of multi-insulated wires, whereby manufacturing costs may be reduced.

In addition, the transformer according to the embodiments of the present invention is configured to be appropriate for an automated manufacturing method. More specifically, in the transformer according to the embodiments of the present invention, the insulating tape according to the related art that has previously been manually interposed while being wound between the coils may be omitted.

In the case in which the related art insulating tape is used, a method of winding the coil in the bobbin, manually attaching the insulating tape thereto, and then winding the coil again is repeatedly performed, which causes an increase in manufacturing time and costs.

However, in the transformer according to the embodiments of the present invention, a process of attaching the insulating tape is omitted, whereby the individual coils may be continuously wound while being stacked in the bobbin by an automatic winding device. Therefore, costs and time required for manufacturing the transformer may be significantly reduced.

Further, the transformer according to the embodiments of the present invention may cause the coil to be connected to the external connection terminals through the lower surface of the terminal connection part as well as the upper surface thereof. Therefore, the lead wires of the coil may be connected to the external connection terminals through more routes, whereby the generation of a short circuit due to contact between the lead wires may be prevented.

In addition, in the transformer according to the embodiments of the present invention, the lead wires of the coils are not disposed within the winding part but directly lead to the outside of the winding part through the lead groove. Therefore, the coils wound in the winding part may be uniformly wound, whereby leakage inductance due to the bending of the coil, or the like, may be minimized.

Further, when the transformer according to the embodiments of the present invention has the lead wire skip part formed in the bobbin, exposure of the lead wires to the outside may be minimized, whereby damages of the lead wires due to physical contact between the lead wires and the outside may be prevented.

In addition, when the transformer according to the embodiments of the present invention is mounted on the substrate, the coil of the transformer is maintained in a state in which it is wound in parallel with the substrate. When the coil is wound in parallel with the substrate as described above, interference between the leakage magnetic flux generated from the transformer and the outside may be minimized.

Therefore, even if the transformer is mounted in a thin display device, the generation of the interference between the leakage magnetic flux generated from the transformer and the back cover of the display device may be minimized. Therefore, a phenomenon in which noise is generated in the display device by the transformer may be prevented. Therefore, the transformer may be easily used in thin display devices.

The above-described transformer is not limited to the above-mentioned exemplary embodiments but may be variously applied. For example, the above-mentioned embodiments describe a case in which the flange part of the bobbin and the partition wall has a rectangular shape by way of example. However, the present invention is not limited thereto. That is, the flange part of the bobbin and the partition wall may also have various shapes such as a circular shape, an ellipsoidal shape, or the like, as necessary.

In addition, although the above-mentioned embodiments describe a case in which the body part of the bobbin has a circular cross section by way of example, the present invention is not limited thereto but may be variously applied. For example, the body part of the bobbin may have an ellipsoidal cross section or a polygonal cross section.

Further, although the above-mentioned embodiments describe a case in which the terminal connection part is formed in the lower flange part or under the lower flange part by way of example, the present invention is not limited thereto but may be variously applied. For example, the terminal connection part may be formed in the upper flange part or over the upper flange part.

Furthermore, although the above-mentioned embodiments describe a case in which the guide protrusions protrude from the lower surface of the terminal connection part and the guide grooves are formed in the upper surface of the terminal connection part by way of example, the present invention is not limited thereto but may be variously applied as necessary. For example, the guide protrusions may be formed on the upper surface of the terminal connection part and the guide grooves may be formed in the lower surface of the terminal connection part.

Moreover, although the above-mentioned embodiments describe the insulating type switching transformer by way of example, the present invention is not limited but may be widely applied to any transformer, coil component, and electronic device including a plurality of coils wound therein.

While the present invention has been shown and described in connection with the embodiments, it will be apparent to those skilled in the art that modifications and variations can be made without departing from the spirit and scope of the invention as defined by the appended claims.

What is claimed is:

1. A transformer comprising:

a winding part including a pipe shaped body part having a plurality of coils wound therearound and flange parts extended from both ends of the body part in an outer diameter direction thereof;

a terminal connection part spaced apart from one end of the winding part by a predetermined distance and including a plurality of external connection terminals connected thereto;

a lead wire skip part disposed in a space between the winding part and the terminal connection part and including lead wires of the coils inserted thereinto to thereby be led to the external connection terminals; and a core coupled to the winding part, wherein a flange part disposed at one end of the body part includes at least one lead groove, wherein the coils are led to the outside of the winding part through the at least one lead groove, and wherein the flange part disposed at one end of the body part has an increased area in a direction in which the lead groove extends, to thereby have an area greater than that of the other flange part.

2. The transformer of claim 1, wherein the winding part includes a plurality of winding spaces divided by at least one partition wall disposed formed on an outer peripheral surface of the body part.

3. The transformer of claim 2, wherein the partition wall includes at least one skip groove disposed therein, and the coils are wound while skipping the partition wall through the at least one skip groove.

4. The transformer of claim 1, wherein the lead wire skip part includes at least one guide protrusion formed therein, the at least one guide protrusion protruding from the terminal connection part or the flange parts.

5. The transformer of claim 1, wherein the lead groove includes a cut portion of the flange part that exposes an outer peripheral surface of the body part.

6. The transformer of claim 1, wherein the flange part formed at one end of the body part includes an extension groove in a portion of the lead groove adjacent to the body part, the extension groove having a wider width than the lead groove.

7. The transformer of claim 6, wherein the extension groove has a chamfered edge portion.

8. The transformer of claim 1, wherein the terminal connection part is exposed outwardly of the core.

9. The transformer of claim 8, wherein the terminal connection part is disposed to be spaced apart from one end of the winding part, by a distance corresponding to a thickness of the core.

10. The transformer of claim 1, wherein the coils include a plurality of primary coils and a plurality of secondary coils.

11. The transformer of claim 10, wherein the coils are wound and stacked such that the plurality of secondary coils are interposed between the plurality of primary coils.

12. The transformer of claim 11, wherein the primary coils are multi-insulated coils.

13. The transformer of claim 1, wherein at least one of the plurality of coils is a multi-insulated coil.

14. The transformer of claim 13, wherein the multi-insulated coil is disposed in at least one of innermost and outermost positions of the coils wound and stacked in the winding part.

* * * * *